United States Patent [19]

Diehl

[11] Patent Number: 5,013,215

[45] Date of Patent: May 7, 1991

[54] BLOWERS FOR FREEZER SYSTEM AND METHODS OF INSTALLATION THEREOF

[75] Inventor: Carl E. Diehl, Troy, Ill.

[73] Assignee: Wetterau Incorporated, Hazelwood, Mo.

[21] Appl. No.: 469,960

[22] Filed: Jan. 25, 1990

[51] Int. Cl.[5] ..... F04D 29/62

[52] U.S. Cl. ..... 416/178; 416/187; 416/204 R; 29/889.4

[58] Field of Search ..... 416/178, 187, 204 R, 416/208; 403/261, 312, 344, 373; 29/889.4

[56] References Cited

U.S. PATENT DOCUMENTS

| | | | |
|---|---|---|---|
| 800,174 | 12/1905 | Slear et al. . | |
| 1,704,123 | 3/1929 | Feinberg et al. | 416/178 |
| 2,537,805 | 1/1951 | Wilken | 416/178 |
| 3,358,913 | 12/1967 | Beesley | 416/178 |
| 3,511,578 | 7/1968 | Horst . | |
| 3,711,914 | 1/1973 | Baker | 416/178 X |
| 3,811,978 | 5/1974 | Wooden | 416/178 X |
| 4,199,302 | 4/1980 | Goettl . | |
| 4,329,118 | 5/1982 | Ranz | 416/178 |
| 4,637,750 | 1/1987 | Ward . | |
| 4,688,987 | 8/1987 | Erickson et al. . | |

*Primary Examiner*—Edward K. Look
*Assistant Examiner*—James A. Larson
*Attorney, Agent, or Firm*—Kalish & Gilster

[57] ABSTRACT

A centrifugal blower assembly of the type having a finned barrel portion to be driven by a shaft by rotation about a longitudinal axis of rotation has the barrel portion divided longitudinally to provide two separable halves. A central hub assembly for securement of the barrel portion to the shaft similarly is divided in separable portions each carried by a respective barrel half. Split clamps secure the hub assembly portions about the shaft in integral relation with the shaft. End rings extending around the barrel at its ends similarly are split into half-ring portions each carried by a respective barrel half. Tongue-like brackets and associated recesses of the half-ring portions secure them in integral relation about the shaft. The blower assembly may be installed and removed from the shaft without its removal. A method of installation, as for installating the blower assembly into cooler units, is disclosed, involving mounting the blower barrel halves in sequence on the shaft while it remains in place in such a cooler unit.

13 Claims, 4 Drawing Sheets

BLOWERS FOR FREEZER SYSTEM AND METHODS OF INSTALLATION THEREOF

BACKGROUND OF THE INVENTION

This invention relates to centrifugal blowers and centrifugal blower systems, and more particularly to freezer systems utilizing such centrifugal blowers and, specifically, to an improved centrifugal blower assembly for use in such systems.

Large centrifugal or so-called "squirrel cage" blowers are used in deep-freeze storage systems of the type by which commercial quantities of food products are quickly frozen or flash-frozen and maintained at temperatures at down to −40° F. Such blowers may, for such use, be carried on shafts which are horizontally mounted within large equipment housings for being turned by large electric motors of horsepower sufficient for delivering immense volumes of super-cooled air into rooms in which food products are to be maintained at such extremely low temperatures. Because of rotational accelerations upon startup and extreme thermal stresses in materials because of the extremes of temperature, such centrifugal blowers have been known to experience a failure at the point of securement of the blower hub to the shaft.

A conventional freezer system installation utilizing such centrifugal blowers may involve the placement of multiple freezer blower housings in proximal relationship. Upon the failure of any given such blower resulting from failure at the point of its hub securement to the shaft may require that only a single blower be replaced and under circumstances requiring that the refrigeration facilities continue to be maintained in operation, such as for the preservation of foodstuffs which are in the refrigerated premises.

When the blower shaft may be several inches in diameter, and where the entire assembly weigh several hundred pounds, it is difficult enough merely to remove the shaft in its entirety from the blower cabinet and cooler assembly. However, where there are adjacent blower units, which continue in operation, distributing large volumes of super-cooled air at high velocity, the complexities and logistics of removing and repairing a blower assembly are traumatic and immense. Such repair and replacement as would be dictated by failure of the point of securement of the blower hub to the shaft might, for example, typically require that workmen carry out the repairs while exposed to the deep-freeze environment of −40° F., where wind-chill equivalent temperatures might be far below such temperature because of the moving volumes of air.

Thus, existing blower technology as utilized in such refrigeration systems presents not only extremes of conditions and difficulties of replacement; there are, in addition, extraordinary costs of both manpower as well as disruption of normal operations while repairs and replacements are effected, greatly adding to the expense of maintaining such large systems, as well as requiring the need for highly skilled, highly paid maintenance personnel, whose talents and efforts might desirably better be applied to other technical areas in the facilities utilizing such systems.

In general, it has been known to provide centrifugal assemblies of the type where the blower assembly hubs may be slid off the shaft after the shaft is removed from any equipment in which the blower is used, such as one of the above blower cabinets. If there are multiple blower cabinets located in proximal relationship, removing one blower may require the removal of adjacent blowers. If the blowers are of extremely large size, replacement may entail opening holes into the walls of the structures containing such blowers so that the large shafts may be removed for permitting replacement of the blower wheels themselves.

SUMMARY OF THE INVENTION

Among the several objects of the invention may be noted the provision of an improved centrifugal blower assembly permitting repair and replacement with extreme economy and facility in the event of blower failure; which avoids the need for costly disassembly of blower systems for replacement of the blower in the event of failure at the point of attachment of the blower to a shaft which carries same; which is utilized to great advantage in heavy duty refrigerator systems, such as of the type utilized for refrigeration of foodstuffs; which is of highly reliable, strongly constructed nature so as to permit substantial increases in reliability and enhanced mean time before failure; and which can be retrofitted to existing equipment with remarkable facility and low cost.

It is also an object of the present invention to provide centrifugal blower improvements which can be incorporated into existing centrifugal blowers by modification of existing centrifugal blowers in a facile, economic and completely effective manner without compromising reliability, strength or good engineering design; and which when so incorporated, results in a blower assembly of such configuration that thereafter it may be readily and easily removed from existing equipment, for replacement purposes, in much less time than existing blower designs, and without requiring disassembly as heretofore required in blower equipment utilizing such centrifugal blowers; and which blower configurations do not require modification of existing blower equipment, whether for installation or replacement.

It is a further object of the invention to provide improved methods of installation and removal of centrifugal blower components, such as particularly utilized in large commercial refrigeration systems; which methods enable blower components to be either removed or installed from existing blower equipment in a much easier and more economical manner than has ever heretofore been possible; which, as used in large-scale refrigeration systems such as for the preservation of foodstuffs, enables replacement of centrifugal blower components in the event of wear or failure with minimal disruption and minimal trauma to maintenance personnel, with greatly reduced cost, and in much less time than has ever before been required.

Briefly, a centrifugal blower assembly of the invention has a finned barrel to be driven by a shaft by rotation about a longitudinal axis of rotation. The barrel is divided longitudinally into portions. There is at least one hub assembly for securement of the barrel portions to the shaft, the hub assembly similarly being divided longitudinally into hub portions. Means is provided for selectively joining the hub portions about the shaft in integral relation with the hub assembly in driving relationship with the shaft, and means is also provided for selectively joining the barrel portions in integral relation about the shaft, whereby the blower assembly may be installed and removed from the shaft without its removal.

A method of installation, as for installing the blower assembly into cooler units involves mounting the blower barrel halves in sequence on the shaft while it remains in place in such a cooler unit.

Other objects and features of the invention will be in part apparent and in part pointed out hereinbelow.

BRIEF DESCRIPTION OF THE DRAWINGS

Corresponding reference characters indicate corresponding parts throughout the several views of the drawing.

DESCRIPTION OF THE PREFERRED EMBODIMENTS

Figure 1:
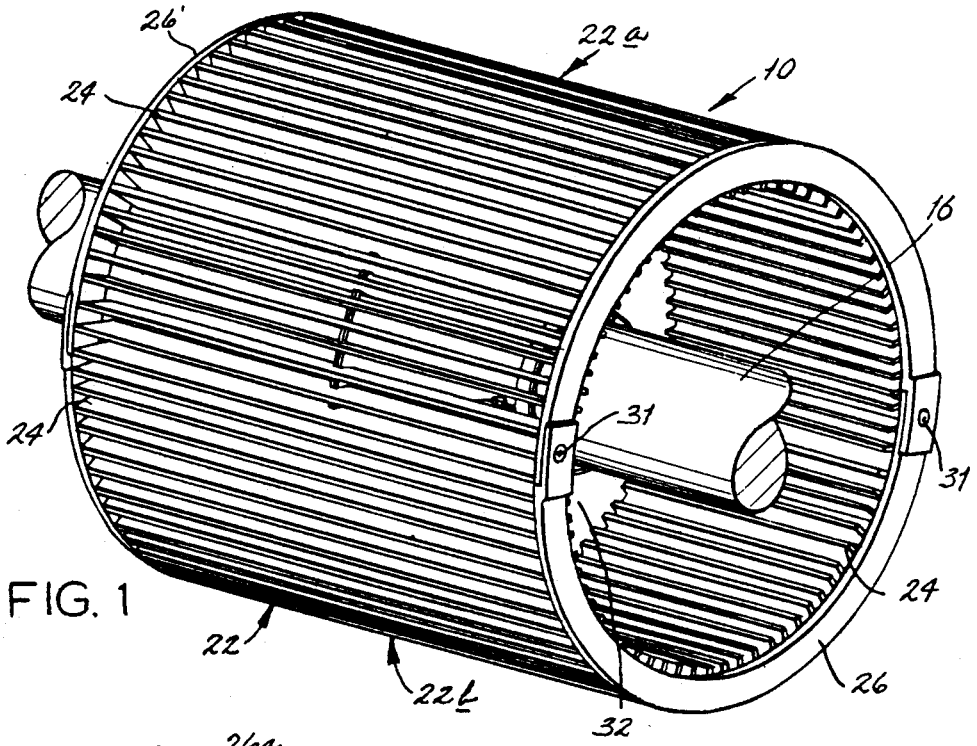
FIG. 1 is a perspective view of a centrifugal blower assembly in accordance with and embodying the present invention.

Referring now to the drawings, and particularly FIGS. 1–4, designated generally at 10 is a centrifugal blower assembly or so-called "squirrel cage" blower wheel as used in pairs in a freezer unit of the type designated 12*a*, 12*b* (FIGS. 5 and 6) within a deep-freeze storage system generally designated 14 of the type having thermally insulated rooms in which commercial quantities of food products are quickly frozen or flash-frozen and/or maintained at temperatures down to −40° F., for example.

Assembly 10, herein referred to for simplicity as a blower, is carried on a drive shaft 16 horizontally mounted within conventional enclosures (described below) in the large equipment housings 18 of units 12*a*, 12*b* for being turned by large electric motors 20 of horsepower sufficient for delivering immense volumes of super-cooled air into areas in which food products are to be maintained at such extremely low temperatures.

Such blower 10 is representative of various types of centrifugal blower wheels used in many different kinds of systems, including heating, ventilating and air-conditioning. In such systems, the blower wheels may be mounted in other than horizontal configuration, and the blower wheels may vary in size.

As thus used for blowing air cooled by cooling coils (not shown) within the cooling units 12*a*, 12*b*, blower 10 is exposed to extremely low temperatures, yet also to normal temperatures when the units are turned off. When the drive motor 20 of such a cooling unit is turned on, high rotational torque is transferred to the blower, which causes stresses at the points of attachment to shaft 16 and associated structure of the blower. The mechanical and thermal stresses may eventually cause failure in blowers of this general type.

The blower comprises a barrel or drum, designated generally 22, formed as joined halves 22*a*, 22*b* dividing drum 22 longitudinally along a plane extending through and including the axis of rotation, each comprised of relatively closely spaced usual fins 24 extending lengthwise between parallel end rings 26, 26' in mutually parallel relationship, as well as parallel with the axis of rotation defined by the axial centerline of shaft 16. End rings 26, 26' are in planar perpendicular relationship to the axial centerline of shaft 16 and so the fins and end rings provide the drum with a customary cylindrical shape.

As is known, such fins may each be angled, i.e., aligned other than radially. They may be curved or otherwise be of airfoil configuration, such as will readily be apparent to those skilled in the art, for exhibiting appropriate aerodynamic qualities.

Figure 2:
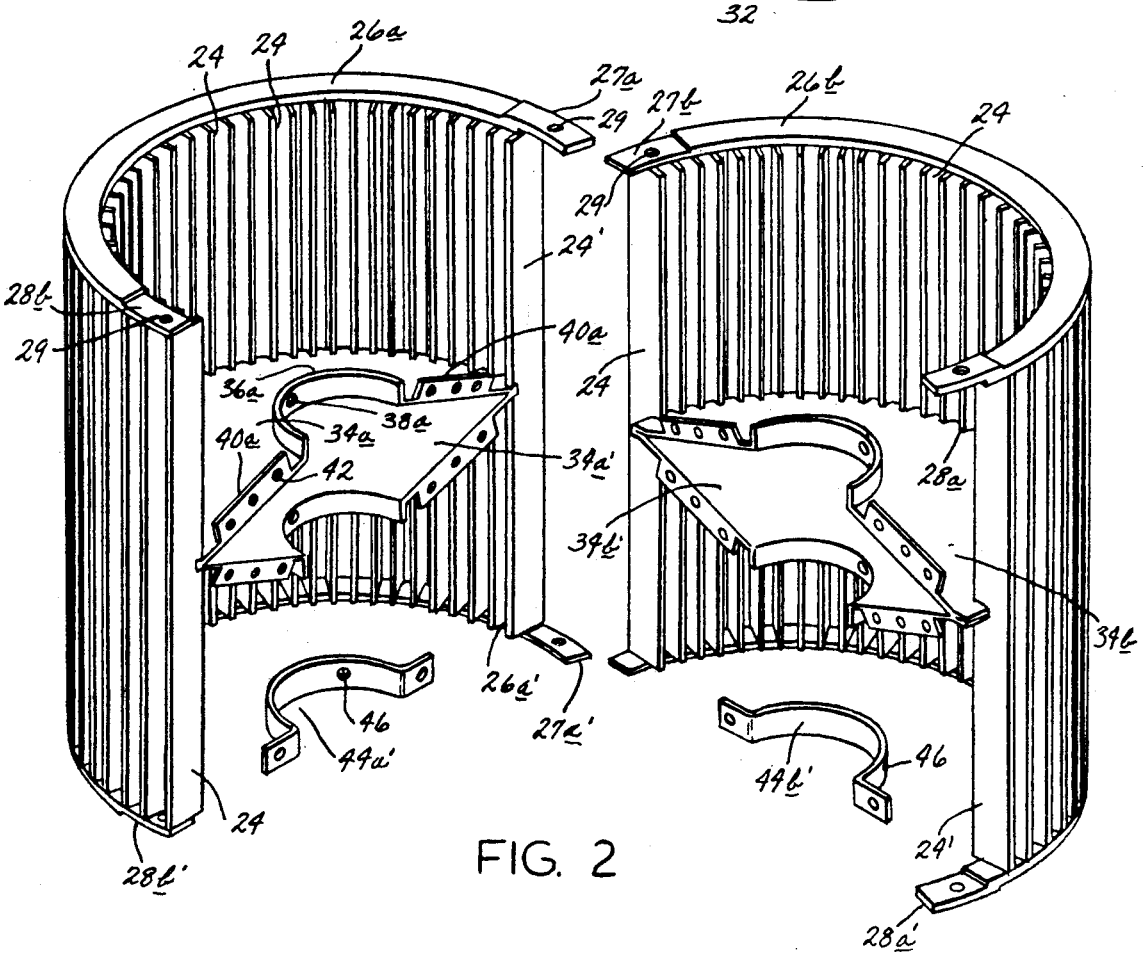
FIG. 2 is a perspective view of the blower assembly of FIG. 1 in disassembled condition.

FIG. 1 illustrates blower 10 in integral form, and mounted upon said shaft 16 but blower barrel halves 22*a*, 22*b* are intended to be separable as shown in FIG. 2. For this purpose, end rings 26, 26', which provide annular rigidity for the joined barrel halves, are comprised of mated half-circle segments 26*a*, 26*b* and 26*a'*, 26*b'*, respectively, which are joined by so-called outer brackets and corresponding bracket recesses, as respectively designated 27*a*, 27*b* and 28*a*, 28*b* for end ring 26 and as similarly designated 27*a'*, 27*b'* and 28*a'*, 28*b'* for end ring 26'. Said outer brackets of the opposed drum halves extend arcuately beyond the last fin, as at 24' of each half and have a stepped configuration for mated, overlapping relation for the recesses when joined. Also, each such outer bracket, e.g., bracket 27*a*, extends axially beyond the outer surface of end ring segment 26*a*, and is intended to overlie and fit within its corresponding recess, e.g., recess 27*b*, which thus lies axially within the outer surface of its ring segment such as 26*b*. Each of said brackets and recesses is provided with at least one aperture as shown, e.g., as those designated at 29, so that machine screws, as at 31 (FIG. 1) will secure the outer brackets and recess-defining ring portions together in joined relation.

For securement to shaft 16 and being driven by it, blower 10 has a hub 32 of joined hub disks 34, 34' (FIG. 4) which are in the form of cones opening mutually inwardly and joined at their outer extremity as by welding to provide a rim 36 about the periphery of which the fins 24 are in turn welded. Each hub disk is split in the same plane as the end rings so as to provide within each of the drum halves 22*a*, 22*b* hub disk halves as designated at 34*a*, 34*a'* and 34*b*, 34*b'* (FIG. 2). Each such hub disk half is outwardly flanged both about its inner periphery and along its radial separation with the corresponding disk half forming the respective hub disk.

Hub disk half 34*a* is typical. Referring to FIG. 2, it includes a longitudinally outwardly directed hub flange 36*a*, apertured at 38*a* (for purposes presently appearing) and configured for conformance with the periphery of shaft 16, and a similarly outwardly directed pair of radial flanges 40*a* each multiply apertured as at 42 for machine screw securement with the corresponding radial flange of the other hub disk half 34*b*. The split-hub arrangement thereby provided permits the disk halves to be secured together, and each of the resulting hub disks 34, 34' to be secured in turn to shaft 16.

Figure 3:
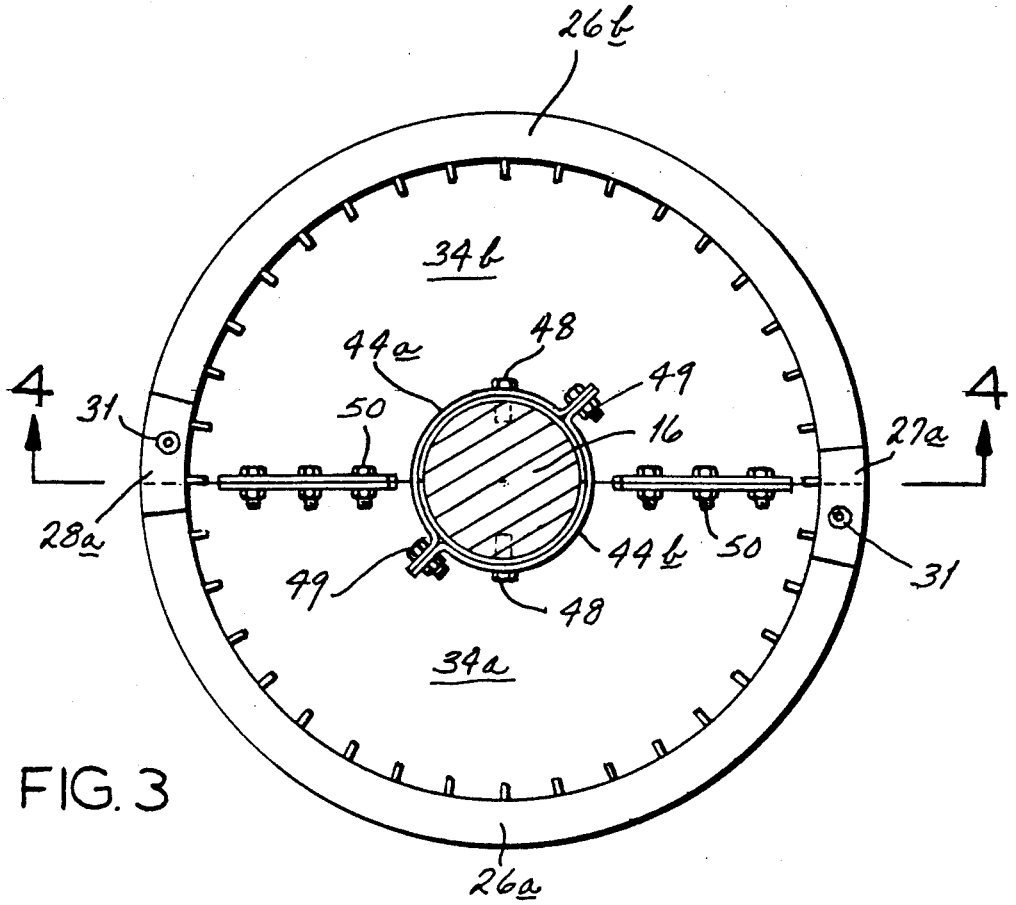
FIG. 3 is an end elevation view of the blower assembly of FIG. 1, as shown mounted upon an operating shaft which is illustrated in sections to demonstrate the manner of securement.
Figure 4:
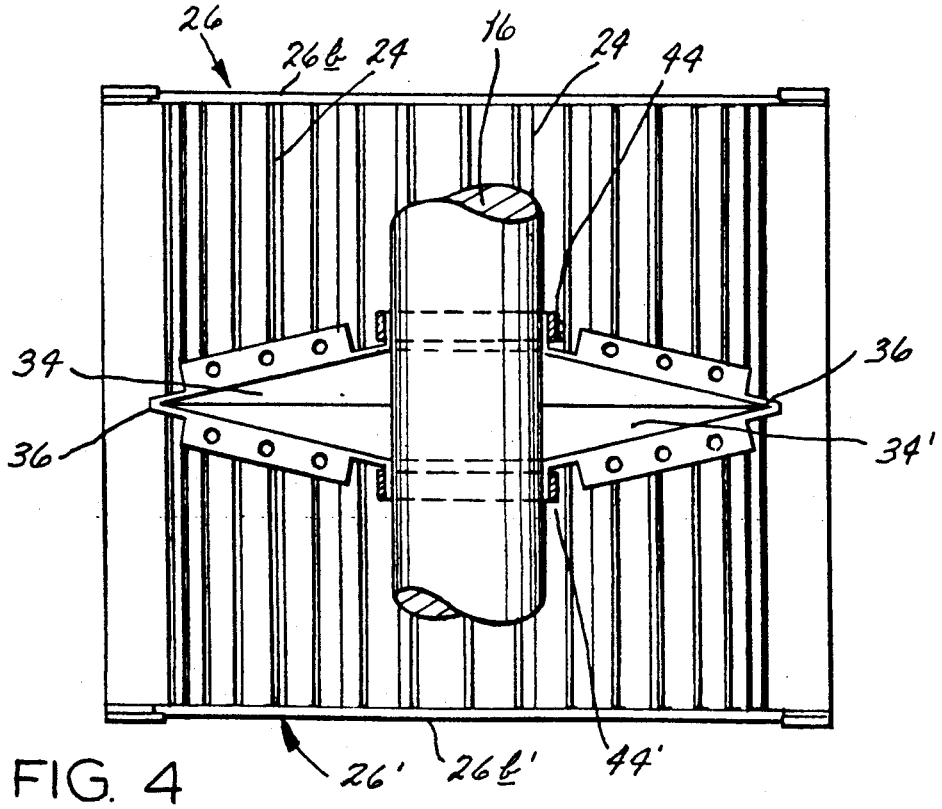
FIG. 4 is a transverse longitudinal cross-section of the lower assembly, as taken generally along line 4—4 of FIG. 3.

The securement of the hub to shaft 16 is brought about by the use of drive shaft clamp halves such as those shown at 44a', 44b' in FIG. 2 and at 44a, 44b in FIG. 3, whereby to provide peripheral hub clamps 44, 44', as seen in the sectional view of FIG. 4. The drive shaft clamp halves are apertured as shown at 46 in FIG. 2, to provide alignment with the flange apertures such as at 38a, so that the hub can be affixed to drive shaft 16 by large machine screws as shown at 48 (FIG. 3), with the drive shaft clamp halves secured by screw-and-nut assemblies 49 and hub halves maintained in joined relationship by screw-and-nut assemblies 50.

Prior to installation on shaft 16 in a cooler unit, the elements of FIG. 2 are completely assembled, mounted on a shaft, as in FIG. 1, and dynamically balanced. A complete unit assembly may then be kept in readiness for immediate installation in a cooling unit, as at 12a or 12b, in the event of a conventional blower failure of this type of unit.

Figure 5:
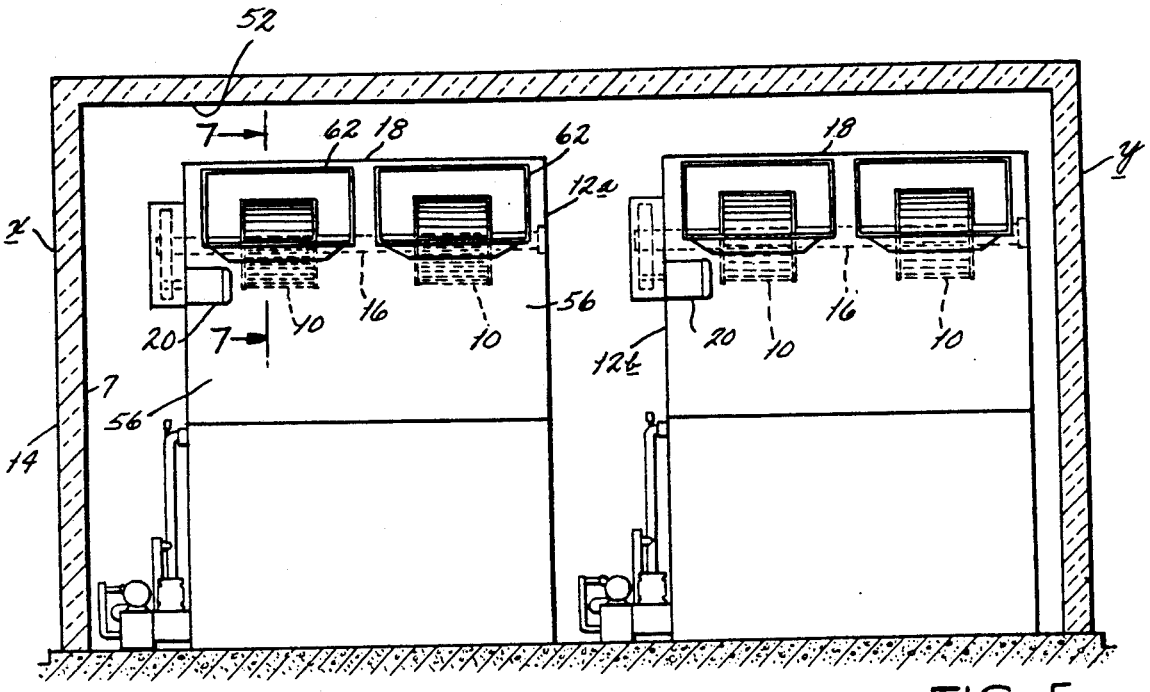
FIG. 5 is an elevation view, as taken through a structure in cross-section, illustrating a pair of freezer units each utilizing blower assemblies of the invention.
Figure 6:
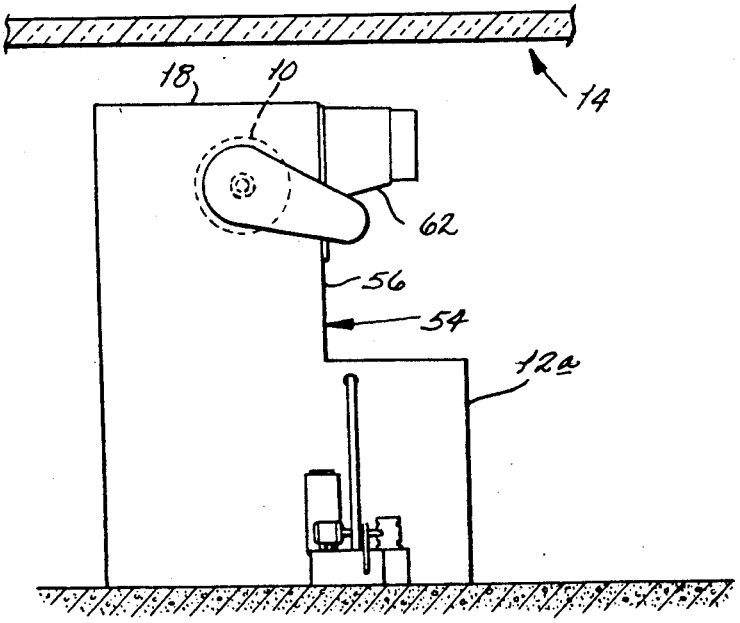
FIG. 6 is a similar elevation view, from one end, of such a freezer unit.

Referring to FIGS. 5 and 6, the deep-freeze storage system generally designated 14 has a thermally insulated room 52 in which freezer units 12a, 12b each have been equipped with a blower 10. The proximal location of units 12a, 12b with alignment of drive shafts 16 presents the most intimidating problem in the event of failure of a normal blower, as the removal of either shaft 16 by shifting it axially through the blower or out through the sides of the freezer units seems virtually impossible, and can be accomplished (and is routinely carried out in large freezer installations) by the entire removal of one of the freezer units or by opening a hole into a wall (which may sometimes be a building structural wall) of room 52, as at x or y. Drastic though such procedure may seem, it may be required for shaft removal.

Where the blowers 10 of units 12a, 12b are of the presently inventive configuration, such shaft removal is entirely avoided, for it is unnecessary when blower removal or reinstallation is in accordance with methodology of the invention.

As will now be readily apparent, the barrel halves 22a, 22b of blower 10 can now be separated or joined at will, and it will be further understood that either such half can be separated from the other while the latter is still in place on shaft 16. That is, the blower can be disassembled—or assembled—by halves. Further, if blower 10 is in place on shaft 16, but its points of securement have loosened or failed, it can be removed from the shaft by removing one of the halves 22a, 22b followed by removal of the other half. The obverse is true also. One of the drum halves may be installed on shaft 16. The other half then may be installed. The invention thus also relates to a method of installing (or removing) a blower assembly of the invention without requiring shaft removal. Stated another way, for installation or removal, the blower assembly need not pass by (and traverse) the end of shaft 16.

Figure 7:
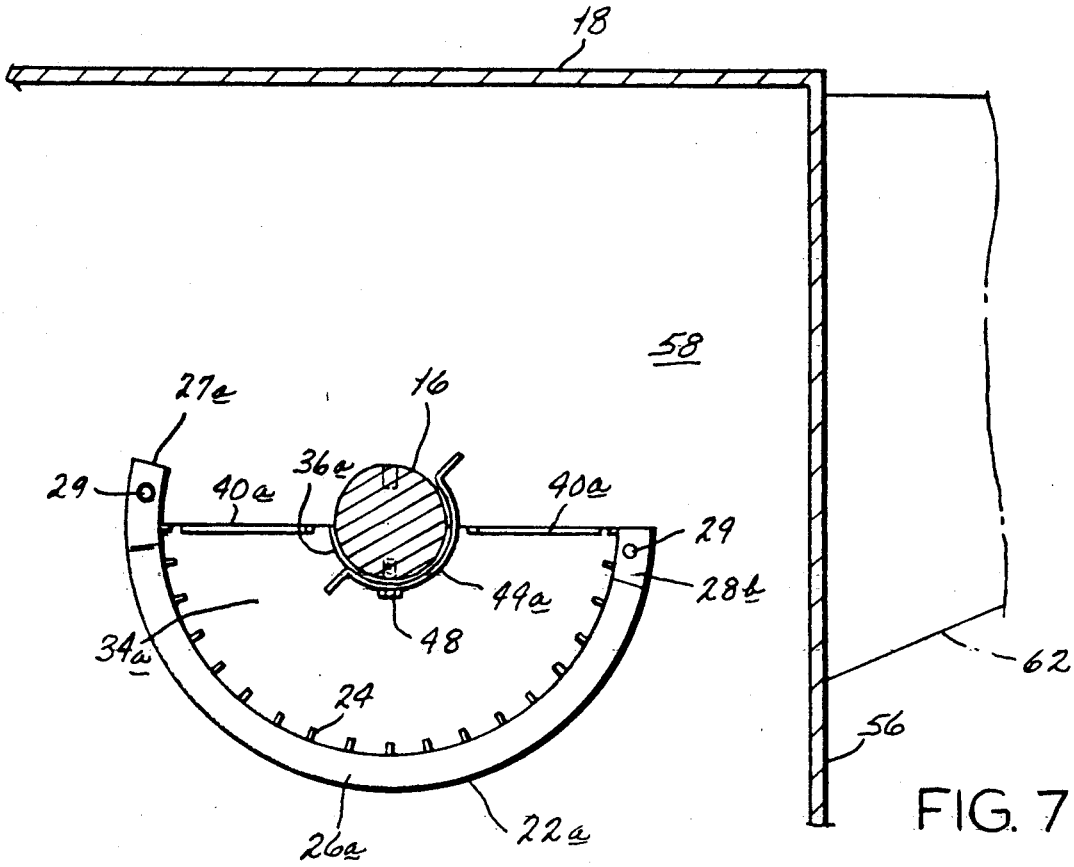
FIG. 7 is a fragmentary vertical cross-section through upper portions of such a freezer unit showing a first step in the installation of a blower assembly within the freezer unit in accordance with methodology of the invention.
Figure 8:
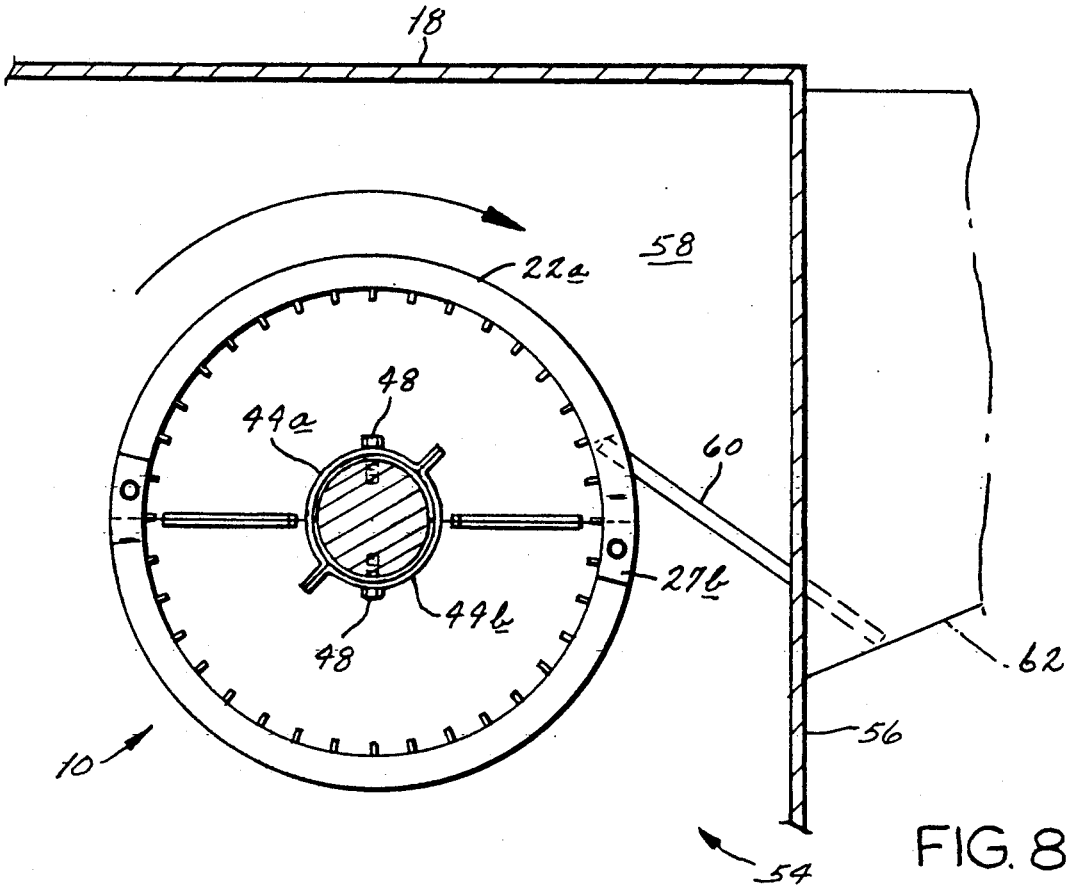
FIG. 8 is a similar fragmentary vertical cross-section showing a further step in the installation thereof.

Referring to FIGS. 7 and 8, simplified cross-sectional illustrations of one of the freezer unit housings 18 depict methods of installation and removal of a blower 10 of the present invention relative to one of the freezer unit housings. As the method of removal is a reversal of the steps needed to install blower 10, it is sufficient to illustrate only the procedures applicable to installation.

Housing has a suitable opening, as through which access is gained by appropriate removal of covers, etc., and generally designated 54, which opening extends across at least a portion along the front face 56 at a position which permits access to shaft 16 and blower 10 (as in the orientation shown in FIG. 8), whereby maintenance personnel may reach inwardly of a blower compartment or space 58 across which shaft 16 extends, and permitting access sufficiently to reach parts of blower 10 and shaft 16, which shaft remains in place and need not be removed.

Referring to FIG. 7, assume that shaft 16 has had removed from it a failed blower, such as original equipment (as by cutting away portions of the old blower and loosening any shaft securement bolts) A new blower barrel half 22a of the invention is inserted through opening 54 and suitably jacked or propped into position with the disk collar flanges, as that designated 36a, urged upwardly against shaft 16 with half 22a thus occupying a position immediately below and surrounding the bottom half of shaft 16, and permitting thereby the installation of a first pair of each of the clamp halves, as that shown at 44a and insertion of the first pair of shaft screws, as at 48. Blower barrel half 22a, now is suspended self-supportedly from shaft 16. This assembly may now be rotated through approximately 180° until half 22a is immediately above shaft 16 where it may be secured in stable position, as by simply using a prop 60 braced against an air deflection outlet 62 which extends forwardly from the face 56 of the unit.

The other blower barrel half 22b may now be inserted into housing interior 58 and raised into place against shaft 16, thus occupying a position immediately below and surrounding what is now the bottom half of shaft 16. The other pair of hub clamps, as at 44b (FIG. 8) may now be installed and permitting thereby the installation of another pair of shaft securement bolts or screws 48 into the present bottom half of shaft 16.

The disk half inner brackets can now be fastened together, and so also the outer brackets, as at 27a, are fastened into the corresponding bracket recesses, as at 28b, by screws, etc. When the fastening elements 31, 48, 49, 50 are all secure, the housing 18 may have its access openings covered, and installation is complete.

As the entire blower 10 previously has been dynamically balanced, normal operation immediately can be initiated.

In the event of a failure after a long period of operation (e.g., years), removal of the blower elements is simply carried out in order reversed from the procedure described above.

The blower configurations described above may be carried out on an existing blower wheel, which may have its end rings cut and provided with brackets and recesses as described, and its center hub components replaced with hub disks 34, 34' of the configuration described. After dynamic balancing as above described, the modified blower, now provided with halves 22a, 22b, can safely be installed in an existing freezer blower unit in the event of a failed blower, such as original equipment.

Installation and removal of blower components of the invention as described above may be carried out so readily, even in the deep-freeze ambient environment of the freezer room 52 in which maintenance personnel would carry out the repairs, that disruption of normal operation can be avoided.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. An easily installable and removable centrifugal blower assembly comprising a finned barrel to be driven by a shaft by rotation about a longitudinal axis of rotation, the barrel being divided longitudinally into portions, at least one hub assembly for securement of the barrel portions to the shaft, the hub assembly similarly being divided longitudinally into hub portions, selectively fastenable and unfastenable means for selectively joining the hub portions about the shaft in assembled integral relation with the hub assembly in driving relationship with the shaft, and selectively fastenable and unfastenable means for selectively joining the barrel portions in integral relation about the shaft, and fastener means for securing the hub assembly to the shaft for driving relationship, whereby the blower assembly may be installed and removed from the shaft without its removal.

2. An easily installable and replaceable centrifugal blower assembly comprising a finned barrel portion to be driven by a shaft by rotation about a longitudinal axis of rotation, the barrel portion having barrel halves dividing the barrel longitudinally, the barrel portion including at least one hub assembly for securement of the barrel portion to the shaft and similarly divided longitudinally into first and second hub portions each carried by a respective barrel half, selectively fastenable and unfastenable first joining means for securing the hub portions in integral relation about the shaft, and fastener means for securing the hub assembly to the shaft for driving relationship, and ring means extending around the barrel for annular rigidity thereof, the ring means comprising first and second half-ring portions each carried by a respective barrel half, and selectively fastenable and unfastenable second joining means for securing the first and second half-ring portions in integral relation about the shaft, whereby the blower assembly may be installed and removed from the shaft without its removal.

3. A centrifugal blower assembly according to claim 2, wherein the barrel halves and hub portions are separable for dividing the barrel portion along a plane extending through and including the axis of rotation.

4. A centrifugal blower assembly according to claim 2, wherein the ring means comprises an end ring at each end of the barrel assembly, each such end ring being divided longitudinally along a plane into two half-ring portions.

5. A centrifugal blower assembly according to claim 4, wherein the second joining means comprises a bracket-defining means carried at one end of each half-ring portion for being received by a corresponding bracket-receiving means at one end of a corresponding opposite half-ring portion.

6. An easily installable and replaceable centrifugal blower assembly comprising a finned barrel portion to be driven by a shaft by rotation about a longitudinal axis of rotation, the barrel portion having barrel halves dividing the barrel longitudinally, the barrel portion including at least one hub assembly for securement of the barrel portion to the shaft and similarly divided longitudinally into first and second hub portions each carried by a respective barrel half, selectively fastenable and unfastenable first joining means for securing the hub portions in integral relation about the shaft, and fastener means for securing the hub assembly to the shaft for driving relationship, and ring means extending around the barrel for annular rigidity thereof, the ring means comprising first and second half-ring portions each carried by a respective barrel half, and selectively fastenable and unfastenable second joining means for securing the first and second half-ring portions in integral relation about the shaft, whereby the blower assembly may be installed and removed from the shaft without its removal, wherein the barrel halves and hub portions are separable for dividing the barrel portion along a plane extending through and including the axis of rotation and the hub assembly comprises first and second disk members each divided along said plane into half-disk portions, the disk members being constituted by respective cones opening mutually inwardly and joined at their outer peripheries to respective barrel halves, each of the disk members being flanged about its inner periphery to provide hub flanges.

7. A centrifugal blower assembly according to claim 6, wherein the first joining means comprises a split clamping means for clamping the hub flanges about the shaft.

8. A centrifugal blower assembly according to claim 7, wherein the half-disk portions each have radial flanges, the first joining means further comprising means securing together radial flanges of corresponding pairs of the half-disk portions.

9. An easily installable and replaceable centrifugal blower assembly comprising a finned barrel portion to be driven by a shaft by rotation about a longitudinal axis of rotation, the barrel portion having barrel halves dividing the barrel longitudinally, the barrel portion including at least one hub assembly for securement of the barrel portion to the shaft and similarly divided longitudinally into first and second hub portions each carried by a respective barrel half, selectively fastenable and unfastenable first joining means for securing the hub portions in integral relation about the shaft, and fastener means for securing the hub assembly to the shaft for driving relationship, and ring means extending around the barrel for annular rigidity thereof, the ring means comprising first and second half-ring portions each carried by a respective barrel half, and selectively fastenable and unfastenable second joining means for securing the first and second half-ring portions in integral relation about the shaft, whereby the blower assembly may be installed and removed from the shaft without its removal wherein the ring means comprises an end ring at each end of the barrel assembly, each such end ring being divided longitudinally along a plane into two half-ring portions, the second joining means comprising a bracket-defining means carried at one end of each half-ring portion for being received by a corresponding bracket-receiving means at one end of a corresponding opposite half-ring portion, and the bracket-defining means is an extension at one end of each half-ring portion and the bracket-receiving means is a recess of the opposite half-ring portion for receiving such extension.

10. A method of installing a centrifugal blower assembly upon a blower drive shaft of a blower unit having an internal space, through which space the shaft extends, without first removing the shaft from the blower unit, the blower assembly having two selectively separable and joinable halves of barrel-like configuration dividing the assembly longitudinally, the method comprising the steps of:

(a) inserting a first blower assembly half into the space;

(b) securing the first blower assembly half to the numbershaft;

(c) rotating the shaft and first blower assembly half and shaft through an arcuate extent;

(d) inserting a second blower assembly half into the space;

(e) securing the second blower assembly half to the shaft on a side of the shaft opposite from the first blower assembly half; and (f) securing the first and second blower assembly halves together in joined relationship.

11. A method of installing a centrifugal blower assembly according to claim 10 wherein the arcuate extent is approximately 180°.

12. A method of installing a centrifugal blower assembly according to claim 10 wherein the shaft extends horizontally through the internal space, step (b) comprises suspending the first blower assembly half from a bottom half of the shaft, step (c) comprises rotating the first blower assembly half and shaft through approximately 180°, and step (e) comprises suspending the second blower assembly half from the side of the shaft opposite from the first blower assembly half.

13. A method of installing a centrifugal blower assembly according to claim 12 and further comprising, after step (c) and before step (d), blocking the shaft and first blower assembly half in a position with the first blower half above the shaft.

* * * * *

UNITED STATES PATENT AND TRADEMARK OFFICE

CERTIFICATE OF CORRECTION

PATENT NO. : 5,013,215

DATED : May 7, 1991

INVENTOR(S) : Carl E. Diehl

It is certified that error appears in the above-identified patent and that said Letters Patent is hereby corrected as shown below:

Col. 9, line 9 - Replace "numbershaft" with --shaft--.

Signed and Sealed this

Eighth Day of September, 1992

*Attest:*

DOUGLAS B. COMER

*Attesting Officer*

*Acting Commissioner of Patents and Trademarks*